United States Patent [19]

Ito et al.

[11] Patent Number: 4,636,756

[45] Date of Patent: Jan. 13, 1987

[54] APPARATUS FOR VARYING THE MAGNETIC FIELD FOR A MAGNETIC RESONANCE ELEMENT

[75] Inventors: Seigo Ito, Tokyo; Yoshikazu Murakami, Kanagawa, both of Japan

[73] Assignee: Sony Corporation, Tokyo, Japan

[21] Appl. No.: 769,896

[22] Filed: Aug. 27, 1985

[30] Foreign Application Priority Data

Aug. 30, 1984 [JP] Japan ..... 59-180941

[51] Int. Cl.[4] ..... H01P 1/218; H01P 1/203

[52] U.S. Cl. ..... 333/202; 333/205; 333/223; 333/235; 335/298

[58] Field of Search ..... 333/202–205, 333/219, 221–223, 235, 24.1, 24.2, 208–212; 335/296–298; 331/96

[56] References Cited

U.S. PATENT DOCUMENTS 4,016,510 4/1977 Hodges, III et al. ..... 333/24.2

FOREIGN PATENT DOCUMENTS 2521786 8/1983 France ..... 333/202

*Primary Examiner*—Marvin L. Nussbaum

*Attorney, Agent, or Firm*—Hill, Van Santen, Steadman & Simpson

[57] ABSTRACT

Apparatus for varying the magnetic field in a magnetic resonant element which comprises a magnetic yoke with one or more magnets mounted within the magnetic yoke so as to generate a substantially uniform magnetic field in the magnetic yoke and a plurality of magnetic resonance elements located in the magnetic field formed by the magnet and including adjusting means for varying the magnetic reluctance between the magnetic yoke and the magnet at a position which is opposite the position of the plurality of magnetic resonance elements. The magnetic reluctance can be varied to arrive at the desired strength of the magnetic field.

3 Claims, 10 Drawing Figures

APPARATUS FOR VARYING THE MAGNETIC FIELD FOR A MAGNETIC RESONANCE ELEMENT

CROSS-REFERENCES TO RELATED APPLICATIONS

The present application is related to the following applications assigned to the assignee of the present application: "Magnetic Apparatus" Ser. No. 708,851, filed Mar. 6, 1985 in which the inventors are Seigo Ito and Yoshikazu Murakami; "Ferromagnetic Resonator" Ser. No. 557,953, filed Dec. 5, 1983, now U.S. Pat. No. 4,547,754, in which the inventors are Yoshikazu Murakami and Hiromi Yamada; patent application Ser. No. 740,899, filed June 3, 1985 entitled "Signal Converter" in which the inventors are Yoshikazu Murakami, Seigo Ito, and Toshiro Yamada, and patent application entitled "Tuned Oscillator", Ser. No. 740,813, filed June 3, 1985 in which the inventors are Yoshikazu Murakami, Seigo Ito and Toshiro Yamada.

BACKGROUND OF THE NVENTION

1. Field of the Invention:

This invention relates in general to a magnetic apparatus for applying a magnetic field to magnetic resonance elements and, in particular, to an improved means for adjusting the magnetic field.

2. Description of the Prior Art:

In prior art filters using magnetic resonance elements such as YIG (yttrium, iron and garnet) and the like, it is customary to use a permanent magnet or an electromagnet to apply a biasing magnetic field to the magnetic resonance element. In a filter, the filtering frequency of which is fixed, a permanent magnet is used because the permanent magnet is small and consumes substantially no power.

FIGS. 7 and 8 illustrate a prior art magnetic apparatus for applying a bias magnetic field to a magnetic resonance element in a filter. FIG. 7 is a section view of the filter illustrated in FIG. 8. A magnetic yoke 1 made of soft magnetic material such as iron and so forth is formed with a central opening which is formed with threads 1*a*. A disc 2 is formed with external threads which mate with the threads 1*a* so as to allow the disc 2 to be adjusted upwardly and downwardly relative to FIG. 7 so as to adjust the magnetic gap. The upper surface of the disc 2 is formed with a number of depressions 2*a* into which a suitable tool can be inserted for rotating the disc 2 for adjusting it relative to the yoke 1. A permanent magnet 4 is attached to a plate 3 which is attached to the disc 2 as illustrated.

A second permanent magnet 5 is attached to a lower surface of the yoke 1 and magnetic field exists between the permanent magnets 4 and 5 so as to provide magnetic bias for magnetic resonant elements 6 and 7 mounted on a high frequency circuit board or plate 10 and which is attached to the walls of the yoke 1 between the magnets 4 and 5 as illustrated.

A pair of thin plate-shaped magnetic resonant elements (YIGs) 6 and 7 are mounted on the circuit board or plate 10 in the magnetic field between the magnets 4 and 5. The magnetic resonant elements 6 and 7 may form YIG filters having two stages, for example. A microstrip line 8 illustrated in FIG. 8 extends across the magnetic resonant elements 6 and 7 and provides input and output. A ground conductive layer 9 is deposited on the entire surface on one side of the plate or board 10 and provides a ground conductive layer as is discussed in detail in the applications listed under copending applications and the disclosure of these applications is hereby incorporated by reference.

In the apparatus of FIGS. 7 and 8, the magnetic field may be adjusted by rotating the disc 2 so as to move the magnet 4 toward or away from the magnet 5 so as to adjust the density of the magnetic field in which the elements 6 and 7 are mounted. It is necessary and desirable that the magnetic field applied to the magnetic resonant elements 6 and 7 have the same intensity so that the resonance frequencies of the magnetic resonant elements will be the same, but in the apparatus of FIGS. 7 and 8, the magnetomotive forces of the magnets 4 and 5 are not uniform in a practical example. Thus, as shown in FIGS. 9 and 10, the resonant frequency and the intensity of the magnetic fields of the magnetic resonant elements will be changed when the magnetic 4 is moved by rotating the disc 2 and these variations depend upon the inside configurations of magnets 4 and 5. In a particular example, the diameter of the magnets 4 and 5 was 25 mm.

When the structure of FIGS. 7 and 8 are rotated on the disc 2 to vary and adjust the intensities of the bias magnetic fields the fields will not be uniform.

SUMMARY OF THE INVENTION

The prior art magnetic apparatus illustrated in FIGS. 7 and 8 has a number of defects. Even if the magnets 4 and 5 are rotated, it is very difficult to maintain the intensity of the bias magnetic fields applied to the magnetic resonance elements 6 and 7 equal. Also, when the disc 2 is rotated, the parallel relationship of the magnets 4 and 5 is changed or the position of the magnets 4 and 5 are displaced in the lateral direction which varies the filter characteristics of the filter formed by the magnetic resonant elements 6 and 7.

The present invention provides a magnetic apparatus which can easily and accurately vary the magnetic fields which are applied to a plurality of magnetic resonance elements.

The present invention provides a magnetic system for magnetic resonant elements wherein one or more fixed magnets are permanently mounted to a yoke structure with the magnetic resonance elements therebetween and the magnetic yoke is formed with a pair of threaded openings adjacent at least one of the permanent magnets into which threaded bolts are received so that they can be adjusted relative to the openings to adjust the biasing magnetic field applied to the magnetic resonance elements.

The threaded bolts can be individually adjusted and are generally aligned with different magnetic resonance elements so as to adjust the magnetic field of the associated magnetic resonance elements.

The present invention allows the magnetic bias on the magnetic resonant elements to be independently and accurately adjusted.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 9:
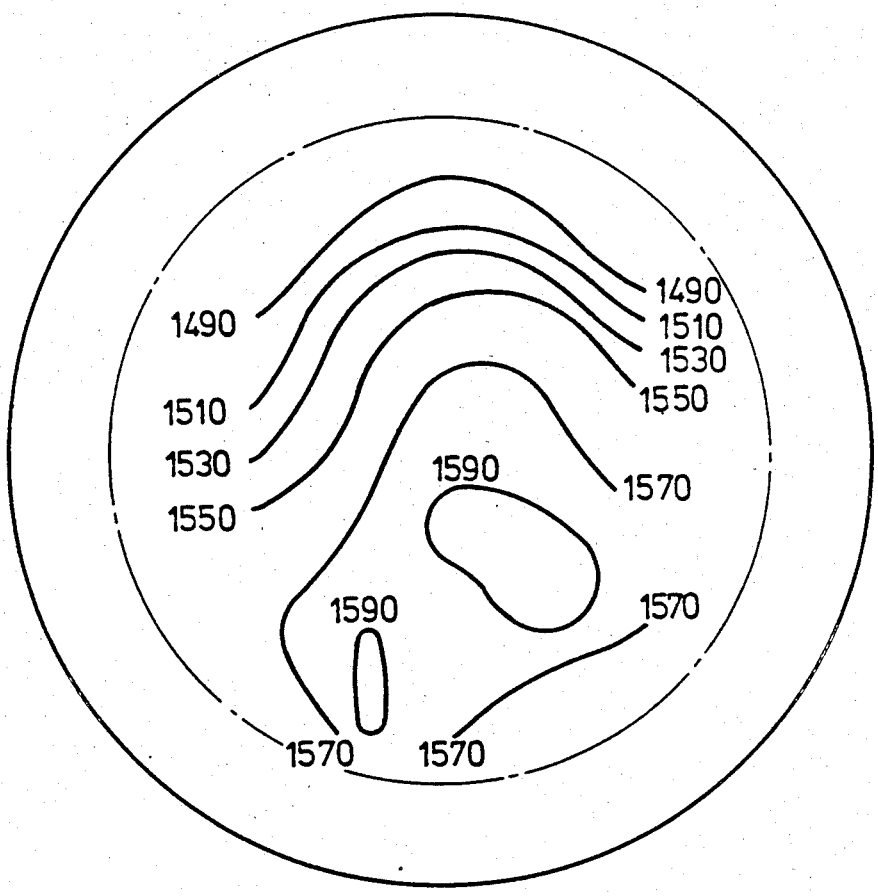
FIG. 9 is a distribution characteristic graph illustrating magnetic resonant frequency.
Figure 10:
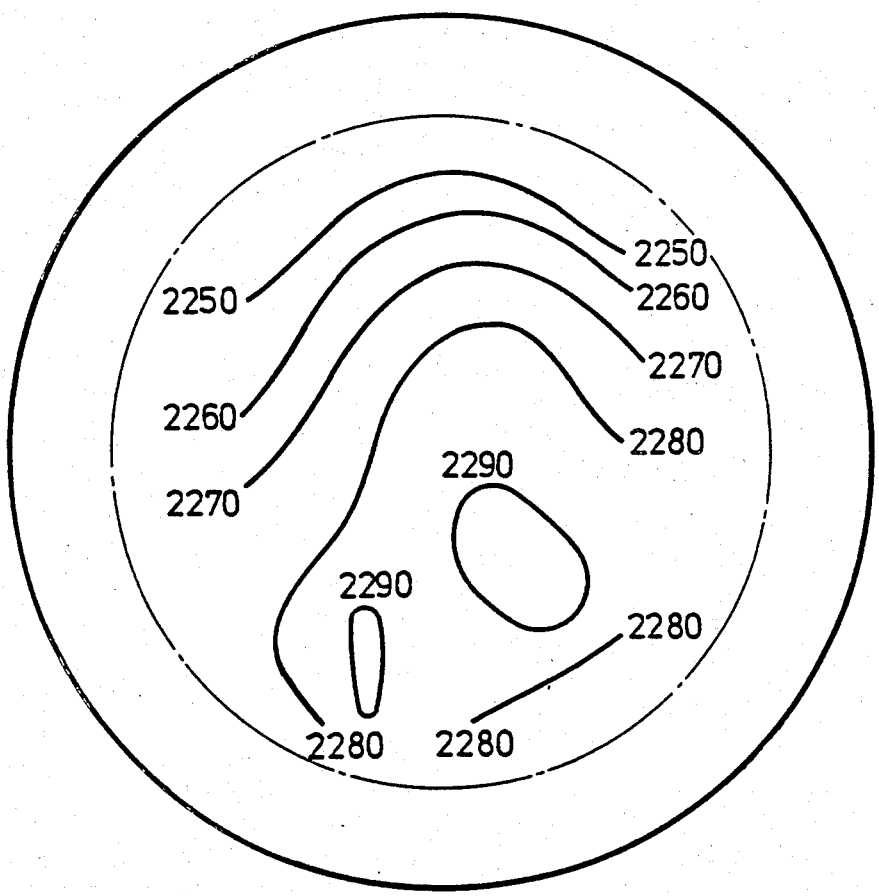
FIG. 10 is a distribution characteristic graph illustrating magnetic field.

It is known that the magnetic field intensity applied to the magnetic resonance elements 6 and 7 must be the same so as to make the resonant frequencies the same, but in the prior art devices such as illustrated in 7 and 8, the magnetomotive forces of the magnets 4 and 5 are not uniform. Thus, as is shown in FIGS. 9 and 10, the resonant frequency and the intensity of the magnetic field of the magnetic resonance elements varies when the magnetic resonance elements are moved on the high frequency circuit board or are respectively changed with certain distributions according to the inside configuration of the magnets 4 and 5. In a particular example, the diameter of the magnets 4 and 5 was 25 mm.

Figure 1:
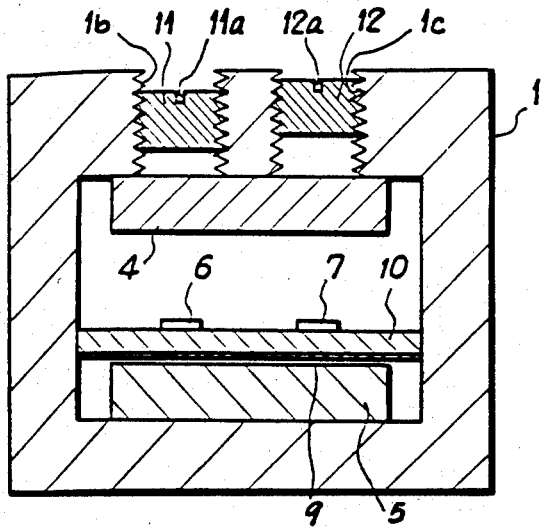
FIG. 1 is a sectional view of the invention.
Figure 2:
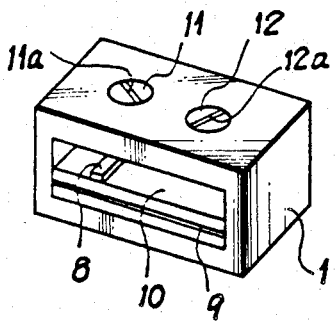
FIG. 2 is a perspective view of the invention.
Figure 8:
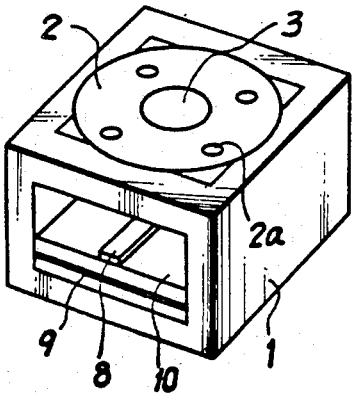
FIG. 8 PRIOR ART
FIG. 8 is a perspective view of the apparatus of FIG. 7.
Figure 7:
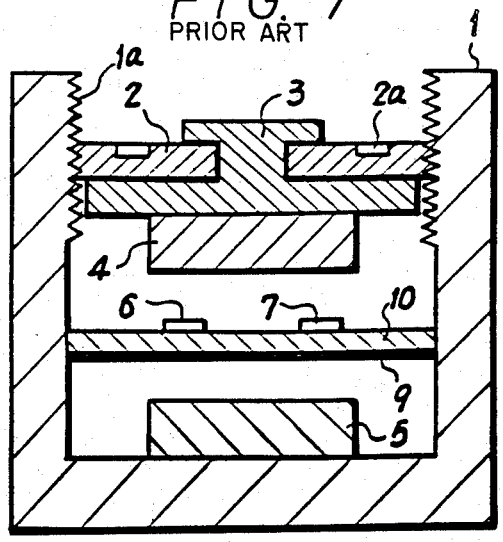
FIG. 7 PRIOR ART
FIG. 7 is a sectional view of a magnetic adjusting means of the prior art.

The invention is illustrated in FIGS. 1 and 2 and comprise a magnetic yoke 1 of generally rectangular shape as illustrated in FIGS. 1 and 2 with a first permanent magnet 4 attached to the top surface of the inside opening of the yoke and a second magnet 5 attached to the bottom surface relative to FIGS. 1 and 2 of the yoke. The magnets 4 and 5 establish a substantially uniform magnetic field within the magnetic yoke 1. A plurality of magnetic resonance elements 6 and 7 are mounted in the magnetic field generated by the magnets 4 and 5 and are mounted on a printed circuit board 10 which has a conductive layer 9 on one surface thereof and the magnetic resonance elements 6 and 7 are mounted on the other surface.

Magnetic adjusting means 11 and 12 are provided in the top surface of the yoke 1 and comprise a pair of threaded openings **1*b* and 1*c* into which are received headless bolt adjusting elements 11 and 12. The headless bolt magnetic adjusting elements 11 and 12 are made of a suitable magnetic material as, for example, iron and are formed with slots 11*a* and 12*a* to allow them to be adjusted upwardly and downwardly relative to FIG. 1 so as to adjust the magnetic coupling of the yoke 1 and, thus, vary the magnetic reluctance in the yoke which changes the magnetic field between the magnets 4 and 5 which is applied to the magnetic resonance elements 6 and 7**.

The magnetic resonance elements 6 and 7 may be YIG elements and they may form FIG filters having two stages and an input and output microstrip line 8 is coupled to the magnetic resonance elements 6 and 7.

The headless bolts 11 and 12 are made of soft magnetic material such as iron and may be of the same material of the magnetic yoke 1. The magnetic reluctance can be adjusted with a screwdriver which is inserted into the grooves **11*a* and 12*a* of the headless bolts 11 and 12 to rotate them to adjust them upwardly and downwardly in the threaded openings 1*b* and 1*c* to adjust the magnetic reluctance between the magnet 4 and the magnetic yoke 1 and thereby to vary each of the bias magnetic fields which is applied to the magnetic resonance elements 6 and 7**. Thus, the biasing magnetic fields can be made to be equal or different from each other as desired.

In the magnetic apparatus illustrated in FIGS. 1 and 2, the magnets 4 and 5 are not moved relative to the yoke, but are maintained in a fixed position and, thus, the spacing between the magnets 4 and 5 does not vary and the magnetic fields which are applied to the magnetic resonance elements 6 and 7 can be easily and accurately varied by the headless bolts 11 and 12. Thus, there will be no deterioration of the high frequency characteristic such as isolation of the high frequency circuit board 10 which occurs when the magnets 4 or 5 are moved as in the prior art. Also, since the headless bolts 11 and 12 can be respectively rotated, the resonant frequencies of the magnetic resonance elements 6 and 7 can be independently adjusted so that filter characteristics will be excellent and the optimum point of the filter can be easily determined.

The diameters of the threaded openings **1*b*, 1*c* and the headless bolts 11 and 12 can be adjusted so as to have larger or smaller diameters so as to increase the variable range of the magnetic field adjustment. Since the magnets 4 and 5 are fixedly attached to the magnetic yoke 1, the shape of the magnets 4 and 5** is not limited to a disc shape, but can be any desired shape such as rectangular shpaed or other selected shape. Thus, the magnetic apparatus can be formed to be smaller than those of the prior art.

Figure 3:
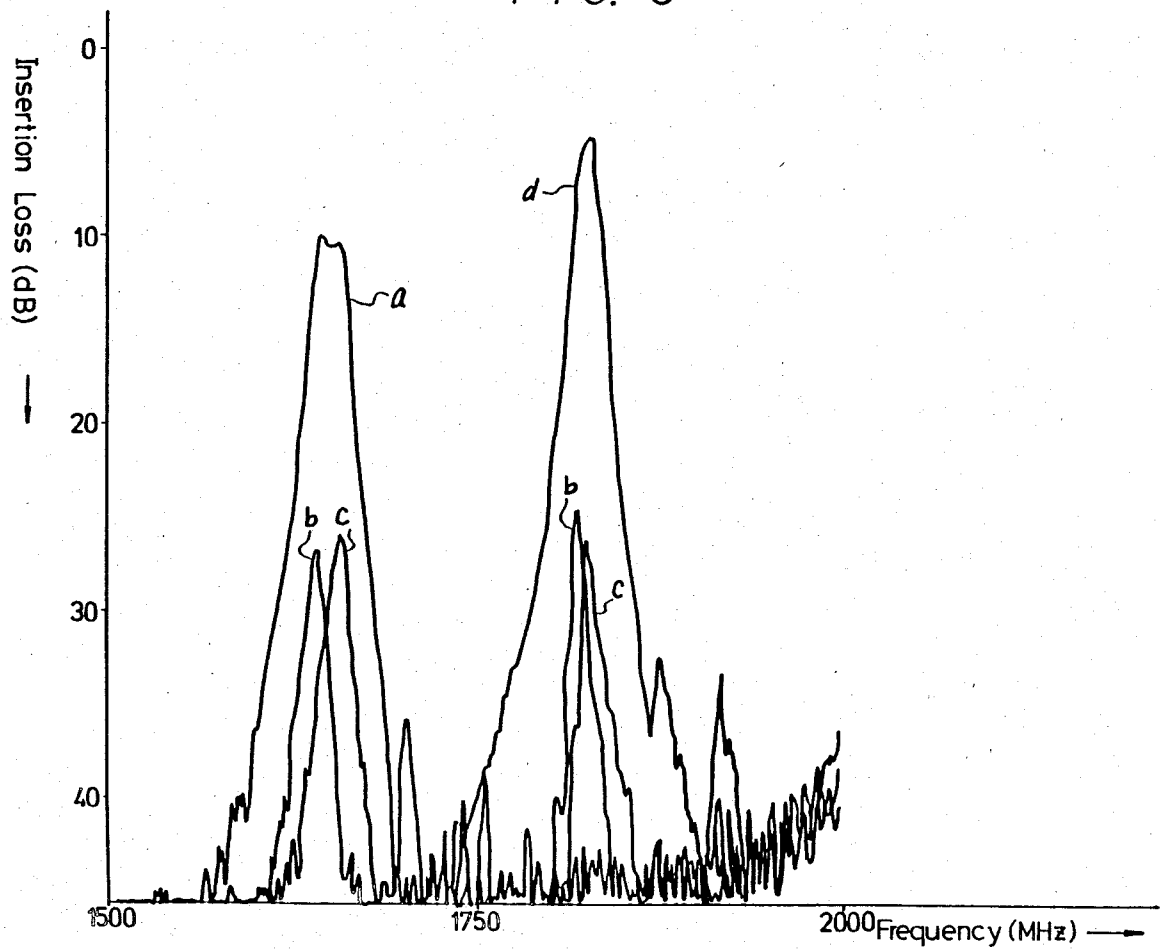
FIG. 3 is a graph illustrating the characteristic of the YIG filter of the invention.

FIG. 3 illustrates a measured result of the filter characteristic of the magnetic apparatus in FIGS. 1 and 2.

FIG. 3 is a graph illustrating the characteristic of the YIG filter where the diameter of the headless bolts 11 and 12 is 4 mm. As illustrated in FIG. 3, curve a indicates the characteristic where the headless bolts 11 and 12 are completely removed from the internal threaded openings **11*b* and 11*c* and the minimum insertion loss is 10 dB. Curve b illustrates the characteristic when one of the headless bolts 11 or 12 is removed from the yoke and the minimum insertion loss is 26 dB. Curves c illustrates the characteristic when the other of the headless bolts 11 or 12 is removed from the yoke and the minimum insertion loss is 26 dB. Curves d illustrates the characteristic in which the headless bolts 11 and 12 are both inserted into the internal threaded openings 11*b* and 11*c* and the minimum insertion loss is 5 dB. It can be observed from the graph of FIG. 3** particularly the curves a through d that the center band pass frequency can be varied over a range of 150 MHz.

Figure 4:
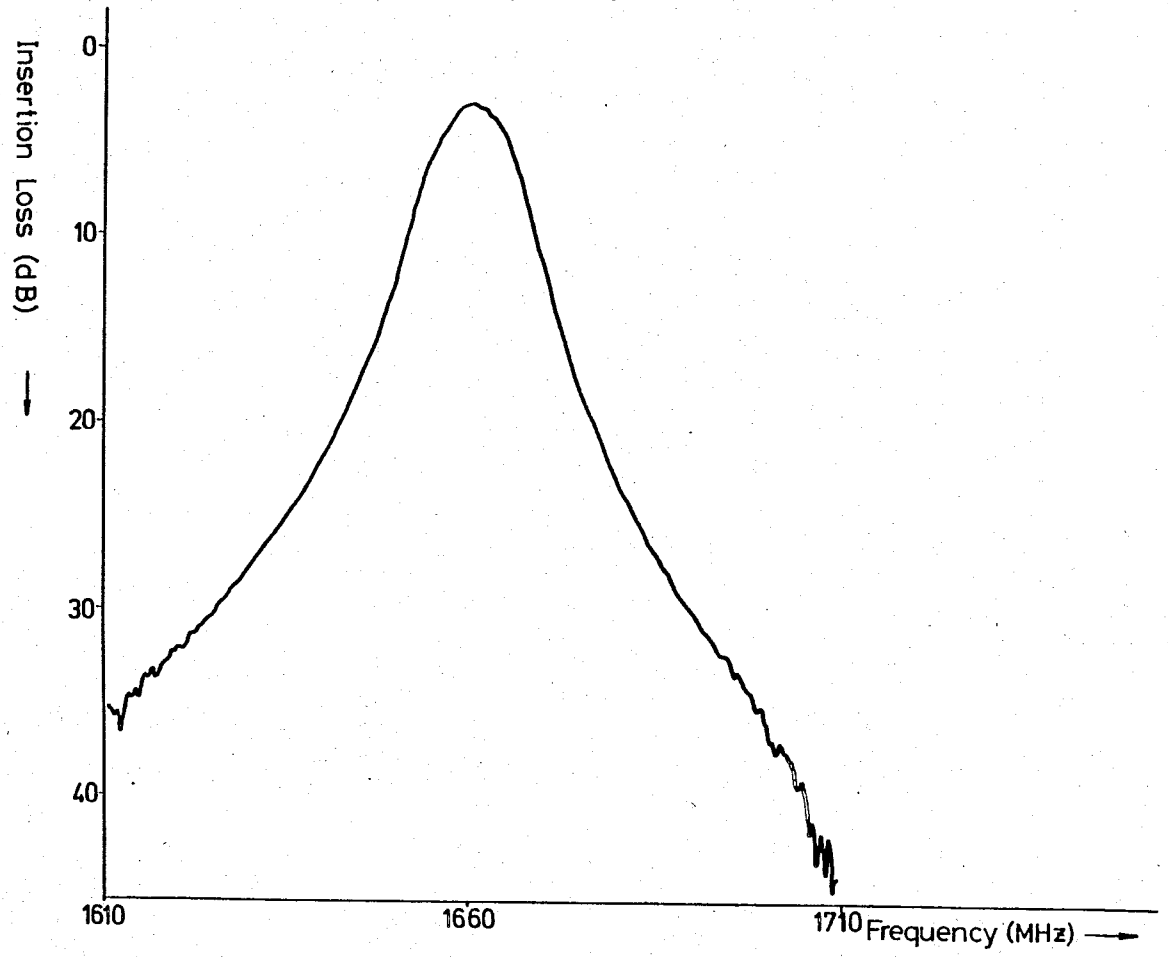
FIGS. 4, 5 and 6 illustrate a characteristic of the filter according to the present invention.
Figure 5:
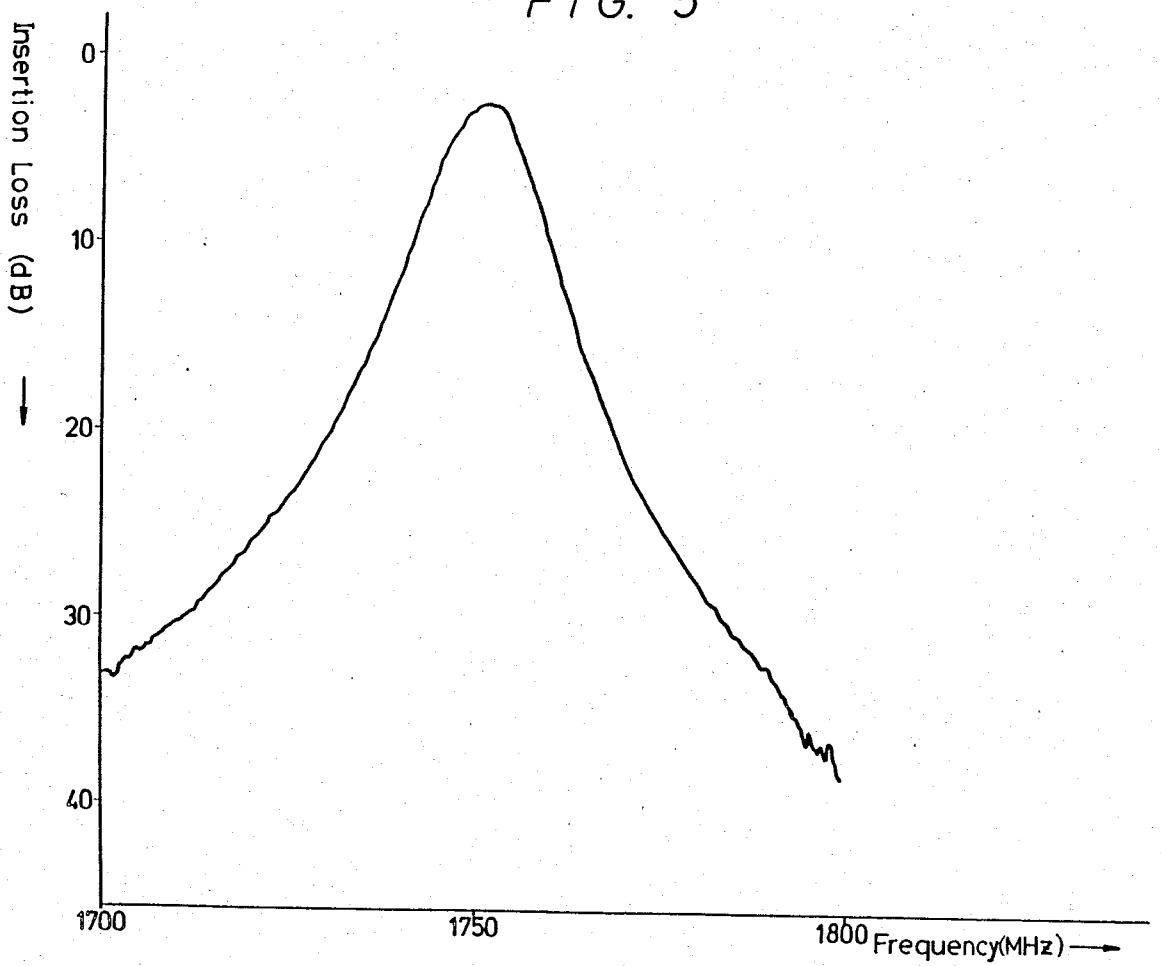
Figure 6:
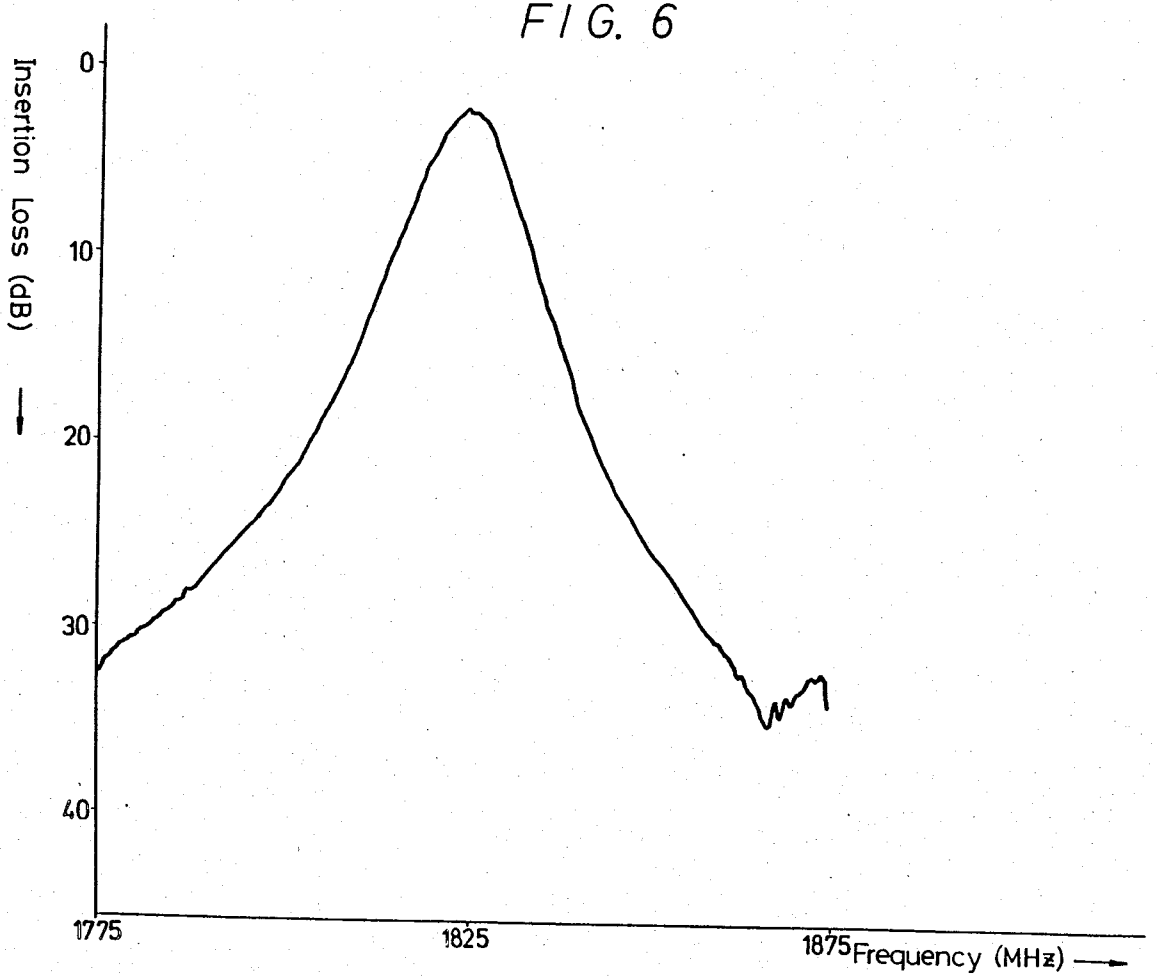

FIGS. 4, 5 and 6 are graphs in which the headless bolts 11 and 12 are both inserted into the internal threaded openings **11*b*, 11*c* and then are, respectively, adjusted to obtain the optimum filter characteristic. FIG. 4 illustrates the minimum insertion loss of 3.0 dB and the bandwidth where the insertion loss is lower than the minimum insertion loss by 3 dB is 11.7 MHz. FIG. 5 illustrates a filter wherein the minimum insertion loss is 2.7 dB and the bandwidth where the insertion loss is lower than the minimum insertion loss by 3 dB is 12.5 MHz. In FIG. 6, the minimum insertion loss is 2.3 dB and the bandwidth where the insertion loss is lower than the minimum insertion loss by 3 dB is 11.0 MHz. FIGS. 4, 5 and 6 illustrate that the center frequency of the bandpass filter can be varied over a range from 1660 to 1825 MHz. Also, the minimum insertion loss of 5–10 dB before adjustment as illustrated by curves a and b in FIG. 3 can be improved so as to be 2–3 dB as illustrated in FIGS. 4, 5 and 6** by adjusting the filter characteristic so that they are optimum.

Modification of the magnetic apparatus of the invention can be made as, for example, a pair of magnetic apparatuses such as illustrated in FIGS. 1 and 2 with a common magnetic yoke can be utilized and the high frequency circuit board 10 can be sandwiched between two upper and two lower magnets. A plurality of headless bolts opposing the magnets of both the upper and lower ends of the yoke can be provided which are varied and adjusted to thereby vary and adjust the magnetic fields which are applied to the plurality of magnetic resonance elements. Also, in the magnetic apparatus illustrated in FIGS. 1 and 2, the magnet 5 can be eliminated and the apparatus can be operated with only the magnet 4.

With the invention it is possible to obtain magnetic apparatus which can be easily and stably adjusted with the magnetic fields independently adjusted which is applied to both of the magnetic resonance elements.

Although the invention has been described with respect to preferred embodiments, it is not to be so limited as changes and modifications may be made therein which are within the full intended scope as defined by the appended claims.

We claim as our invention:

1. A magnetic apparatus comprising a magnetic yoke having a gapped portion therein, a magnet mounted on said magnetic yoke and forming a substantially uniform magnetic filed in said gapped portion, a plurality of magnetic resonance elements located in said magnetic field formed by said magnet, and adjusting means for independently varying the magnetic reluctance to selected values between said magnetic yoke and said magnet for each of said magnetic resonance elements and said adjusting means mounted at positions opposing each of said magnetic resonance elements.

2. A magnetic apparatus comprising a magnetic yoke formed with a central opening, at least one magnet mounted in said yoke to produce a magnetic field in said central opening, a first and second magnetic resonance elements mounted in said central opening, means for adjusting said magnetic field in said opening by varying the magnetic reluctance of said yoke and without moving said magnet relative to said yoke, wherein said means for adjusting said magnetic field comprises a first opening formed in said yoke and a first plug of magnetic material moveably mounted in said opening so as to adjust said magnetic field as said first plug is moved in said first opening, wherein said opening formed in said yoke is threaded and is cylindrically shaped and wherein said first plug is threaded and is cylindrical shaped, wherein said plug is formed with a slot so that it can be adjusted with a tool, and wherein said means for adjusting said magnetic field comprises a second opening formed in said yoke and extending parallel to said first opening and a second plug receivably in said second opening and adjustably mounted therein to vary said magnetic field and said first plug is aligned with said first magnetic resonance element to independently adjust its magnetic field and said second plug is aligned with said second magnetic resonance element to independently adjust its magnetic field.

3. A magnetic apparatus according to claim 2 wherein said second opening is threaded and is cylindrically shaped and said second plug is threaded and is cylindrically shaped.

* * * * *